United States Patent [19]

Gottier

[11] Patent Number: 5,011,521

[45] Date of Patent: Apr. 30, 1991

[54] LOW PRESSURE STRIPPING PROCESS FOR PRODUCTION OF CRUDE HELIUM

[75] Inventor: Gerry N. Gottier, Emmaus, Pa.

[73] Assignee: Air Products and Chemicals, Inc., Allentown, Pa.

[21] Appl. No.: 471,252

[22] Filed: Jan. 25, 1990

[51] Int. Cl.[5] ..... F25J 3/00

[52] U.S. Cl. ..... 62/11; 62/24; 62/36; 62/42

[58] Field of Search ..... 62/9, 11, 23, 24, 32, 62/36, 42

[56] References Cited

U.S. PATENT DOCUMENTS

| | | | |
|---|---|---|---|
| 3,260,058 | 7/1966 | Ray et al. | 62/23 |
| 4,740,223 | 4/1988 | Gates | 62/23 |
| 4,758,258 | 7/1988 | Mitchell et al. | 62/25 |

OTHER PUBLICATIONS

"A Step Ahead for Helium", Kellogram #3, 1963.

*Primary Examiner*—Ronald C. Capossela

*Attorney, Agent, or Firm*—Willard Jones, II; James C. Simmons; William F. Marsh

[57] ABSTRACT

The present invention is a process for prefractionating a pressurized, helium-containing feed gas mixture (typically containing helium, natural gas and nitrogen) to produce a helium-enriched stream which comprises the following steps: (a) the pressurized, helium-containing feed gas mixture is liquefied and subcooled by indirect heat exchange; (b) the liquefied, subcooled, pressurized, helium-containing feed gas mixture is expanded whereby it is partially vaporized, thus producing a partially vaporized frationation feed stream; (c) the partially vaporized frationation feed stream is stripped in a cryogenic distillation column thereby producing as an overhead, the helium-enriched stream, and a bottoms liquid, the helium-lean stream; and (d) the cryogenic distillation column is reboiled by vaporizing at least a portion of the helium-lean stream. The present invention is also applicable as an improvement to a process for the production of a crude helium product (i.e., >30 vol % helium).

15 Claims, 1 Drawing Sheet

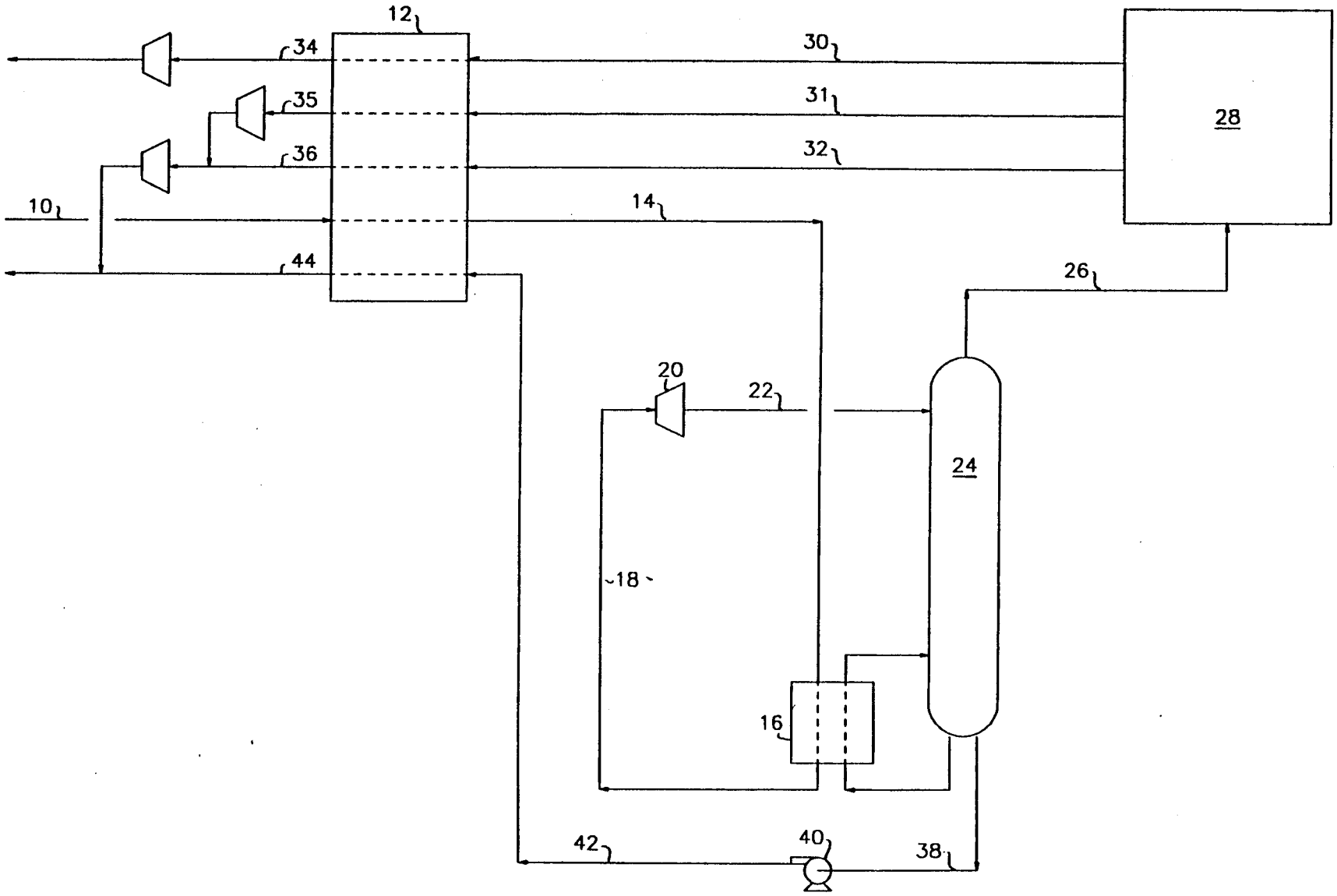
28
26
24
38
40
42
30
31
32
22
16
20
18
14
12
34
35
36
44
10

LOW PRESSURE STRIPPING PROCESS FOR PRODUCTION OF CRUDE HELIUM

TECHNICAL FIELD

The present invention is related to a cryogenic process for production of a crude helium stream (i.e; >30 vol % helium) from a pressurized, helium-containing feed gas mixture and to a cryogenic process for the prefractionation of a pressurized, helium-containing feed gas mixture to produce a helium-enriched stream for further processing.

BACKGROUND OF THE INVENTION

Helium occurs in very low concentrations in certain natural gas fields. Natural gas streams from which helium can be economically recovered typically contain approximately 0.1% to 0.5% helium. This helium must be upgraded to produce a crude helium stream containing typically at least 30% helium.

Producing a crude helium stream is usually done in two or more successive upgrading steps. The first upgrading step generally involves the separation of the feed into a helium-lean gas stream comprising the majority of the feed stream and a smaller helium-enriched stream. It is the most power and capital intensive step in the overall process and it also directly impacts the energy and capital demands of downstream processing.

Existing methods for providing a helium-rich stream from a natural gas feed suffer from one of two drawbacks. The simple, low-capital approach produces a helium-rich stream which has a relatively low concentration of helium yet a relatively high flowrate. On the other hand, the alternate processes which produce a helium-rich stream with a higher helium content and lower flowrate require the use of more complicated equipment which results in a higher capital requirement.

Numerous processes are known in the art for the cryogenic separation of helium from a natural gas stream; among these previous attempts to solve this problem are the multi-stage flash cycle and the high pressure stripping process, both of which involve the recovery of the major portion of the helium in a separation performed at feed pressure.

In the flash cycle, which is disclosed in U.S. Pat. No. 3,260,058, feed gas is partially liquefied and phase separated. The helium-enriched vapor thus produced contains about 80% of the helium contained in the feed gas. Dissolved helium in the liquid portion is recovered by several subsequent flash steps in which small amounts of helium-rich vapor are flashed off and eventually added to the bulk helium-rich stream.

The flash cycle has the advantages of simplicity and low capital cost. However, the concentration of helium in the helium-enriched vapor stream is relatively low. For instance, given a natural gas feed stream containing about 0.4% helium, the concentration of helium in the helium-enriched stream is only about 2%. Therefore, the flowrate of the helium-enriched stream is about 20% of the feed gas flowrate. This relatively high flowrate leads to high capital and power costs for subsequent upgrading steps.

In the distillation (high pressure stripping) process, which is disclosed in "A New Approach to Helium Recovery", Kellogram Issue No. 3, M. H.. Kellogg Co; 1963, feed gas is at least partially liquefied and fed to a distillation step in which dissolved helium is stripped from the liquid at feed pressure. The vapor product from the stripping step contains from 97% to 99.5% of the helium contained in the feed stream.

The high pressure distillation process has the advantage of higher helium content in the helium-enriched stream than the flash cycle. For instance, given a natural gas feed stream containing about 0.4% helium, the concentration of helium in the helium-enriched stream is about 2.5% to 3.0%. Therefore, the flowrate of the helium-enriched stream is about 13% to 16% of the feed gas flowrate. In addition, since the helium-enriched stream is produced at feed pressure, the product streams from the subsequent processing steps can be returned at higher pressure, thereby reducing energy consumption for the crude helium stream recompression.

The disadvantage of the high pressure distillation process is high capital cost due to the difficulty of performing a distillative separation at high feed pressure and the complexity of supplying reboil duty to the stripping column. The difficulty of the separation leads to a relatively high reboil duty required for high helium recovery. This high vapor flowrate coupled with unfavorable surface tension and vapor-liquid density difference leads to large column diameters.

Reboil duty is supplied to the stripping column using a methane heat pump, which requires additional energy and heat transfer equipment. The combination of the large column size and the methane heat pump lead to a high capital cost for this process.

U.S. Pat. No. 4,758,258 discloses another process for cyrogenically separating a helium-bearing natural gas stream comprising subjecting the natural gas stream to a sequence of alternating cooling and separating steps. In the process, one or more process-derived streams are utilized to effect cooling of the natural gas stream to temperatures in the cryogenic range. The process provides for the separation and recovery of a natural gas liquids product stream consisting of substantially condensed $C_2$ and higher hydrocarbons and a gaseous product stream consisting of at least 50 volume percent of helium with the balance being substantially nitrogen.

As is apparent from the above discussion, the prior art is wanting for a simple, efficient, low-cost method of processing a natural gas feed to produce a helium-rich stream with high helium content. The present invention is an answer to that wanting.

SUMMARY OF THE INVENTION

The present invention is a process for prefractionating a pressurized, helium-containing feed gas mixture (typically containing helium, natural gas and nitrogen) to produce a helium-enriched stream which comprises the following steps: (a) the pressurized, helium-containing feed gas mixture is liquefied and subcooled by indirect heat exchange, (b) the liquefied, subcooled, pressurized, helium-containing feed gas mixture is expanded whereby it is partially vaporized, thus producing a partially vaporized frationation feed stream; (c) the partially vaporized frationation feed stream is fed to a cryogenic distillation column for stripping thereby producing as an overhead, the helium-enriched stream, and a bottoms liquid, the helium-lean stream; and (d) the cryogenic distillation column is reboiled by vaporizing at least a portion of the helium-lean stream.

In the process, the liquefied, subcooled, pressurized, helium-containing feed gas mixture is preferably expanded so as to produce mechanical work such as across a hydraulic turbine. Alternatively, it can be expanded across a Joule-Thompson valve.

The present invention is also an improvement to a process for separating a helium-rich fraction as crude helium product containing at least thirty percent by volume (30 vol %) helium from a pressurized, helium-containing feed gas mixture, such as a feed gas mixture containing natural gas, helium and nitrogen. In the process the pressurized, helium-containing feed gas mixture is separated to produce a helium-enriched stream and a helium-lean stream. Further, this helium enriched stream is cooled, partially condensed and flashed to produce the helium-rich fraction and at least one residue stream as residue gas product streams. Optionally, the residue stream can be further processed by means of flashing or stripping to recover a portion of the trace quantities of helium contained in the residue stream, thereby producing a second, helium-rich stream and at least one residue gas product stream. Using this option, the first and second helium-rich streams are combined and recovered as a crude helium product.

The improvement of the present invention is a processing mode to separate more effectively the pressurized, helium-containing feed gas mixture to produce the helium-enriched stream. This mode comprises the following steps: (a) the pressurized, helium-containing feed gas mixture is liquefied and subcooled, (b) the liquefied, subcooled, pressurized, helium-containing feed gas mixture is expanded whereby it is partially vaporized, thus producing a partially vaporized frationation feed stream; (c) the partially vaporized frationation feed stream is stripped in a cryogenic distillation column thereby producing as an overhead, the helium-enriched stream, and a bottoms liquid, the helium-lean stream; and (d) the cryogenic distillation column is reboiled by vaporizing at least a portion of the helium-lean stream.

In the process, the liquefied, subcooled pressurized, helium-containing feed gas mixture is preferably expanded so as to produce mechanical work such as across a hydraulic turbine. Alternatively, it can be expanded across a Joule-Thompson valve.

BRIEF DESCRIPTION OF THE DRAWING

The single figure of the drawing is a schematic of the process of the present invention.

DETAILED DESCRIPTION OF THE INVENTION

As mentioned earlier the present invention is a process for the production of a helium-rich stream from a natural gas feed gas containing small concentrations of helium. The process of the present invention is best understood in relation of the single figure of the drawing. As shown in the single Figure, a natural gas feed stream at a pressure of about 300 to 600 psia and containing about 0.1% to 0.5% helium is introduced through line 10 into main heat exchanger 12, wherein it is liquefied and subcooled, exiting the exchanger at a temperature of about −170 to −200° F. The feed stream is then fed through line 14 into stripping column reboiler 16, in which it is further cooled to a temperature of about −175 to −205° F. The subcooled liquid stream is introduced through line 18 into expander 20, wherein the pressure of the feed stream is reduced to about 150 to 350 psia.

The stream exiting expander 20 is a two-phase stream in which the vapor contains about 85% of the helium contained in the feed gas. This stream is fed through line 22 into distillation column 24 in which the small amount of remaining dissolved helium is stripped from the liquid by stripping vapor generated in reboiler 16.

The vapor recovered off distillation column 24 has a helium content of about 4% to 5%, and its flowrate is only about 10% or less of the feed flowrate. This helium-enriched stream, contains about 99% of the helium contained in the feed gas and is fed through line 26 into a subsequent helium upgrading section 28. This subsequent helium upgrading section can be any of those known in the art, such as is described in U.S. Pat. No. 3,260,058 (particularly the description for FIGS. 1*b* and 2*b*). The specification of U.S. Pat. No. 3,260,058 is hereby incorporated by reference.

In essence, in upgrading section 28, the helium-enriched stream is cooled, partially condensed and flashed (usually in several stages) to produce a helium-rich stream and at least one residue stream. Optionally, the produced residue stream(s) can be further processed by means of flashing or stripping to recover a portion of the trace quantities of helium contained in the residue stream, thereby producing a second, helium-rich stream and at least one residue gas product stream. Using this option, the first and second helium-rich streams are combined and recovered as a crude helium product.

In general, all helium upgrading sections typically produce at least two product streams, a crude helium product containing at least 30% helium and a lower pressure residue gas product; and preferably a third product stream, a higher pressure residue gas product. These products are returned through lines 30, 31 and 32 to main exchanger 12, wherein they are rewarmed to provide feed refrigeration prior to exiting the process in lines 34, 35 and 36.

The liquid product from distillation column 24 has a flowrate which is at least 90% of the feed flowrate. It passes through line 38 to pump 40. in which it is pumped to a pressure of about 240 to 500 psia and fed back to main exchanger 12 through line 42. This liquid stream fully vaporizes in the main exchanger, providing refrigeration for feed liquefaction, and exits the process as high pressure residue gas product in line 44.

It should be noted that the pressure letdown step, expander 20, is important to the effective running of distillation column 24 at reduced pressure. The preferred mode of expanding the subcooled liquid feed stream, i.e. the most energy efficient mode, is with the use of a hydraulic turbine. The turbine mode generates work which reduces the net energy consumption of the process. In addition, it supplies refrigeration which substantially reduces the size of the main exchanger compared to a flash process returning the high pressure residue gas at the same pressure. Alternatively, using the same size main exchanger for the turbine process as for the flash process allows the residue gas to be returned at higher pressure, thus further reducing energy consumption. Nevertheless, the pressure letdown step can be accomplished with a Joule-Thompson expansion valve, and the process would still produce an upgraded helium stream with higher helium content and lower flowrate than processes known in the prior art.

To demonstrate the efficacy of the process of the present invention, the process as depicted in the single figure of the drawing using a hydraulic turbine as the expander was computer simulated. For the simulation, a helium purification section (item 28 in the figure) similar to that disclosed in FIGS. 1*b* and 2*b* of U.S. Pat. No.

3,260,058 was used. In addition, the product streams in lines 34, 35 and 36 have been compressed to the normal required product pressures for each product. The following table provides a simplified material and energy balance by listing stream flow rates, compositions and conditions for selected streams.

| Stream Number | Pressure psia | Temperature °F. | Flowrate mol/hr | Composition (mol %) He | $N_2$ | $C_1$ | $C_2$ | $C_3$ |
|---|---|---|---|---|---|---|---|---|
| 10 | 540 | 70 | 1000 | 0.44 | 14.82 | 78.56 | 5.73 | 0.45 |
| 14 | 527 | −176 | 1000 | 0.44 | 14.82 | 78.56 | 5.73 | 0.45 |
| 22 | 300 | −189 | 1000 | 0.44 | 14.82 | 78.56 | 5.73 | 0.45 |
| 26 | 300 | −189 | 82.1 | 5.16 | 44.52 | 50.18 | 0.14 | — |
| 34 | 275 | 63 | 6.3 | 67.30 | 31.90 | 0.80 | — | — |
| 35 | 70 | 63 | 8.9 | 0.01 | 74.34 | 25.64 | 0.01 | — |
| 36 | 200 | 63 | 66.9 | 0.02 | 41.70 | 58.12 | 0.16 | — |
| 38 | 300 | −185 | 917.9 | 0.01 | 12.16 | 81.10 | 6.11 | 0.50 |
| 44 | 420 | 63 | 917.9 | 0.01 | 12.16 | 81.10 | 6.11 | 0.50 |

In addition to the above information, the computer simulation indicates that the process of the present invention requires approximately 0.85 kHh/1000 SCF of feed gas mixture of power to operate the process.

To further demonstrate the efficacy of the process of the present invention, particularly, in comparison with the process disclosed in U.S. Pat. No. 3,260,058, the process of the prior art was computer simulated on the same basis as the present invention and producing similar products at the same pressure to determine the energy requirements of the process and the flow rate and composition of the helium-enriched stream shown in line 69 of either FIG. 1*a* or 1*b* of the prior art reference. It is important to note that the prior art process was simulated to obtain the same helium product as for the process of the present invention. The results of this simulation are: (a) the energy requirements of the process are 1.49 kWh/1000 SCF of feed gas mixture, and the flow-rate of the prior reference is 217.5 mol/hr. The composition of stream 69 is: 1.95% helium, 31.41% nitrogen, with the balance being natural gas.

As can be seen from the above description and discussion, the present invention is a highly efficient process which maintains the simplicity and low cost of the multi-stage flash cycle while producing a helium-rich stream with a higher helium content and lower flowrate than that produced by the high pressure distillation process.

The process of the present invention achieves low cost and simplicity by several means. First, most of the heat transfer is done in a single main exchanger service. Complex and costly exchanger networks, as depicted, for example in Kellogram Issue No. 3, are thereby avoided. Second, the process is fully auto-refrigerated, requiring only product compression. Finally, the majority of the helium is recovered in the pressure letdown of the feed gas. The duty and therefore the size and cost of the distillation column and reboiler are thereby minimized.

A helium-rich stream with high helium content and low flowrate is achieved by substantial subcooling of the liquefied feed stream prior to letdown across the turbine. This subcooling reduces the amount of methane and nitrogen which flash off with the helium. The added amount of helium which remains dissolved in the liquid due to the subcooling step is recovered with a minimum of methane and nitrogen by the use of the stripping process.

Higher process efficiency is achieved by the production of mechanical work from the expansion of the feed stream, for example the use of a hydraulic turbine for this pressure letdown. The power generated by the turbine is sufficient to drive the pump with some excess power available. Refrigeration created by the turbine increases the temperature differences in the main exchanger, allowing the high pressure residue gas to be returned at higher pressure for a given main exchanger size.

Additionally, the benefits of this process result from performing the first helium upgrading step in a distillation column operating at reduced pressure. The use of a distillation column increases the helium content of the helium-rich stream compared to the flash process, while maintaining equal or greater helium recovery. Increasing the helium content, and thereby decreasing the flowrate, of this stream reduces the capital investment and the power consumption of downstream processing steps.

Prior attempts to use a distillation column for the first helium upgrading step have operated the column at a pressure near the feed pressure. The higher the pressure of the stripping step, the greater the amount of helium dissolved in the liquid phase, and the greater the amount of stripping required. This high stripping duty has in the past been supplied by the use of a methane heat pump which has greatly complicated the process and increased the capital cost by adding a heat pump compressor and a heat pump exchanger network.

Running the stripping process at reduced pressure greatly reduces the amount of helium dissolved in the liquid. Most of the helium is recovered in the vapor phase simply by pressure letdown. Therefore, much less helium has to be recovered in the stripping step. In addition, the relative volatility of helium to methane and nitrogen is much higher at the lower pressure, such that the separation is much easier to perform. The greatly reduced duty of the stripping step allows the reboil duty to be supplied by subcooling the feed stream, thus eliminating the need for the heat pump.

The preferred use of a hydraulic turbine is a further difference from the prior art. Since the low pressure stripping process returns the helium-lean liquid at lower pressure than either the flash process or the high pressure stripping process, the liquid must be pumped to a higher pressure to avoid excessively high recompression requirements for the product gas. The pump energy increases the energy requirements of the process, and the addition of energy to the liquid reduces the temperature differences in the main exchanger, increasing its capital costs. The turbine supplies sufficient power to offset the pump energy, and the refrigeration it supplies maintains greater temperature differences in the main exchanger. Therefore, the use of the turbine allows the process to maintain high efficiency and lower exchanger sizes.

The present invention has been described with reference to a specific embodiment thereof. This embodiment should not be viewed as a limitation on the present invention, the only limitations being ascertained by the following claims.

I claim:

1. A process for prefractionating a pressurized, helium-containing feed gas mixture to produce a helium-enriched stream comprising the steps of:

(a) liquefying and subcooling the pressurized, helium-containing feed gas mixture;

(b) expanding the liquefied, subcooled, pressurized, helium-containing feed gas mixture whereby said liquefied mixture is partially vaporized and thereby producing a partially vaporized frationation feed stream;

(c) stripping the partially vaporized frationation feed stream in a cryogenic distillation column thereby producing as an overhead, the helium-enriched stream, and a bottoms liquid, the helium-lean stream; and (d) reboiling the cryogenic distillation column by vaporizing at least a portion of the helium-lean stream.

2. The process of claim 1 wherein the helium-containing feed gas mixture comprises helium, natural gas and nitrogen.

3. The process of claim 1 wherein the liquefied, subcooled pressurized, helium-containing feed gas mixture is expanded so as to produce mechanical work.

4. The process of claim 3 wherein the helium-containing feed gas mixture comprises helium, natural gas and nitrogen.

5. The process of claim 1 wherein the liquefied, subcooled pressurized, helium-containing feed gas mixture is expanded across a hydraulic turbine.

6. In a process for separating a helium-rich fraction as crude helium product containing at least thirty percent by volume (30 vol %) helium from a pressurized, helium-containing feed gas mixture, wherein the pressurized, helium-containing feed gas mixture is separated to produce a helium-enriched stream and a helium-lean stream, and further wherein the helium-enriched stream is cooled, partially condensed and flashed to produce the helium-rich fraction and at least one residue gas product stream, the improvement for separating the pressurized, helium-containing feed gas mixture more effectively to produce the helium-enriched stream comprises the steps of:

(a) liquefying and subcooling the pressurized, helium-containing feed gas mixture;

(b) expanding the liquefied, subcooled, pressurized, helium-containing feed gas mixture whereby said liquefied mixture is partially vaporized and thereby producing a partially vaporized frationation feed stream;

(c) stripping the partially vaporized frationation feed stream in a cryogenic distillation column thereby producing as an overhead, the helium-enriched stream, and a bottoms liquid, the helium-lean stream; and (d) reboiling the cryogenic distillation column by vaporizing at least a portion of the helium-lean stream.

7. The process of claim 6 wherein the helium-containing feed gas mixture comprises helium, natural gas and nitrogen.

8. The process of claim 6 wherein the liquefied, subcooled pressurized, helium-containing feed gas mixture is expanded so as to produce mechanical work.

9. The process of claim 8 wherein the helium-containing feed gas mixture comprises helium, natural gas and nitrogen.

10. The process of claim 6 wherein the liquefied, subcooled pressurized, helium-containing feed gas mixture is expanded across a hydraulic turbine.

11. In a process for separating a helium-rich fraction as crude helium product containing at least thirty percent by volume (30 vol %) helium from a pressurized, helium-containing feed gas mixture, wherein the pressurized, helium-containing feed gas mixture is separated to produce a helium-enriched stream and a helium-lean stream; wherein the helium-enriched stream is cooled, partially condensed and flashed to produce a first, helium-rich stream and a first residue stream containing trace quantities of helium; wherein the first residue stream is further processed by means of flashing or stripping to further recover a portion of the trace quantities thereby producing a second, helium-rich stream and at least one residue gas product stream; and wherein the first and second helium-rich streams are combined and recovered as the helium-rich fraction, the improvement for separating the pressurized, helium-containing feed gas mixture more effectively to produce the helium-enriched stream comprises the steps of:

(a) liquefying and subcooling the pressurized, helium-containing feed gas mixture;

(b) expanding the liquefied, subcooled, pressurized, helium-containing feed gas mixture whereby said liquefied mixture is partially vaporized and thereby producing a partially vaporized frationation feed stream;

(c) stripping the partially vaporized frationation feed stream in a cryogenic distillation column thereby producing as an overhead, the helium-enriched stream, and a bottoms liquid, the helium-lean stream; and (d) reboiling the cryogenic distillation column by vaporizing at least a portion of the helium-lean stream.

12. The process of claim 11 wherein the helium-containing feed gas mixture comprises helium, natural gas and nitrogen.

13. The process of claim 11 wherein the liquefied, subcooled pressurized, helium-containing feed gas mixture is expanded so as to produce mechanical work.

14. The process of claim 13 wherein the helium-containing feed gas mixture comprises helium, natural gas and nitrogen.

15. The process of claim 11 wherein the liquefied, subcooled pressurized, helium-containing feed gas mixture is expanded across a hydraulic turbine.

* * * * *